United States Patent [19]

Jandeska, Jr. et al.

[11] Patent Number: 4,678,510

[45] Date of Patent: Jul. 7, 1987

[54] WEAR RESISTANT IRON POWDER ARTICLE

[75] Inventors: William F. Jandeska, Jr., Rochester; Vadim Rezhets, Southfield, both of Mich.

[73] Assignee: General Motors Corporation, Detroit, Mich.

[21] Appl. No.: 913,488

[22] Filed: Sep. 30, 1986

Related U.S. Application Data

[63] Continuation-in-part of Ser. No. 813,055, Dec. 24, 1985, abandoned.

[51] Int. Cl.[4] ..... C22C 29/14

[52] U.S. Cl. ..... 75/244; 419/11; 419/12; 419/23; 419/38; 419/58

[58] Field of Search ..... 75/244; 419/11, 12, 419/23, 38, 58

[56] References Cited

U.S. PATENT DOCUMENTS

| | | | |
|---|---|---|---|
| 3,451,809 | 6/1969 | Raman et al. | 419/12 |
| 3,999,952 | 12/1976 | Kondo et al. | 419/12 |
| 4,217,141 | 8/1980 | Schrittwieser | 419/12 |
| 4,618,473 | 10/1986 | Jandeska | 419/12 |

*Primary Examiner*—Stephen J. Lechert, Jr.
*Attorney, Agent, or Firm*—Douglas D. Fekete

[57] ABSTRACT

A wear resistant iron alloy article is preferably formed by compacting and sintering a predominantly iron powder mixture containing additions of carbon, copper and nickel boride. The product microstructure comprises hard borocementite particles dispersed in a martensite or pearlite matrix. The particles have a cross-sectional dimension greater than 1 micron and are present in an amount preferably between 10 and 30 volume percent to improve wear resistance.

7 Claims, 1 Drawing Figure

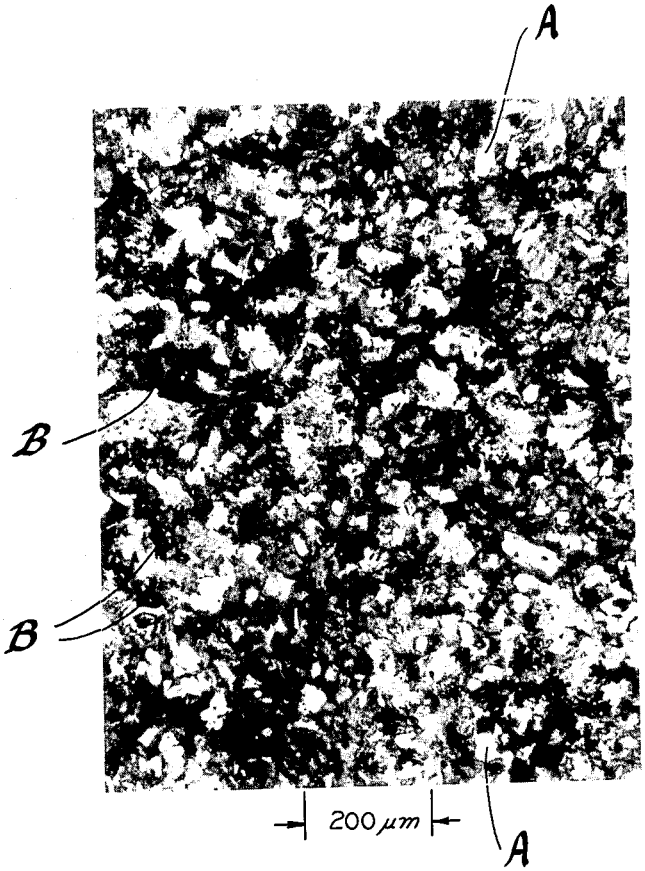
A
B
B
200 μm
A

WEAR RESISTANT IRON POWDER ARTICLE

This is a continuation-in-part of U.S. Ser. No. 813,055 filed December 24, 1985 now abandoned.

BACKGROUND OF THE INVENTION

This invention relates to an iron alloy article formed by sintering an iron powder compact comprising carbon and boron additions. More particularly, this invention relates to a product iron article having a microstructure comprising dispersed large borocementite particles that are sized and distributed to improve wear resistance.

It is known to produce an iron article by compacting iron powder and sintering to diffusion bond the iron into a cohesive structure. The compact contains additives to enhance properties in the product. Carbon powder is added to diffuse into the iron to produce a pearlite or martensite microstructure. Copper may be added for precipitation hardening and enhanced dimensional control. U.S. patent application Ser. No. 745,353, filed June 14, 1985, describes an addition of nickel boride to improve toughness by forming retained austenite about pores that inhibits crack formation.

It is desired in powder metallurgical manufacturing to form a compact that is substantially the size and shape of the desired article so that minimal, if any, machining is required to finish the product. Copper and nickel boride form liquid at preferred iron sintering temperatures. This liquid may enhance diffusion of the agent into the iron. However, if present for a prolonged period, the liquid tends to distort the iron skeleton, so that the sintered article does not conform to the compact.

Also, it is desired to improve wear resistance of the product article. In general, wear resistance of cast iron, in particular cast iron containing chromium, is superior to that of powdered iron articles. This is attributed to the presence of large hard phases in cast iron.

It is an object of this invention to provide an improved iron alloy article formed by compacting and sintering a powder mixture composed predominantly of low-carbon iron powder, which article has a predominantly pearlite or martensite microstructure having dispersed therein hard borocementite particles in an amount and size effective to substantially improve wear resistance.

More particularly, it is an object of this invention to provide a powder metallurgical method for forming a wear-resistant iron alloy article by sintering an iron powder compact comprising a carbon additive and a boron additive, which sintering is effective to cause the carbon and the boron to diffuse into the iron structure away from pores and to concentrate at interior regions to form hard borocementite particles.

In a preferred aspect of this invention, it is an object to provide a powder metallurgical method for forming an iron alloy article having improved wear resistance by compacting and sintering an iron powder mixture comprising carbon powder, a metal boride powder and copper powder, which sintering involves formation of a liquid phase for a time sufficient to promote diffusion of the additives into the iron, but not so long as to produce significant skeletal distortion. The boride powder includes a metal that promotes diffusion of carbon and boron into interior regions of the structure. Similarly, copper promotes carbon and boron diffusion into the interior regions. As a result, carbon and boron concentrate at the interior regions to produce hard borocementite particles that substantially improve wear resistance.

DESCRIPTION OF THE INVENTION

In a preferred embodiment, an iron alloy article formed by this invention comprises hard borocementite particles dispersed within an iron alloy matrix. The matrix is predominantly martensite or pearlite. The particles have a cross-sectional dimension greater than 1 micron. Furthermore, the hard particles are present in an amount at least 4 volume percent, preferably between 10 and 30 volume percent. It is found that the hard borocementite particles, when present in such size and quantity, are effective to substantially improve wear resistance.

The iron alloy article is preferably formed by compacting and sintering an intimate powder mixture composed mainly of low-carbon iron powder and comprising between about 1 and 2 weight percent carbon powder and between about 2 and 3 weight percent copper powder. As used herein, weight percent is reported with reference to the total of product metal, and does not include the weight of fugitive materials, such as vaporizable lubricant added to facilitate processing, that are expended during sintering and do not contribute to the product weight. In addition to carbon and copper, the mixture contains a metal boride powder, preferably nickel boride. The boride is added in an amount sufficient to produce a boron content in the product article of between about 0.15 and 1.2 weight percent. The preferred nickel boride addition is between about 0.8 and 3.1 weight percent. Optionally, a portion of the boron may be added as iron boride.

During sintering, the predominant iron particles become diffusion bonded into a cohesive skeletal structure, which structure includes interstitial pores characteristic of iron powder structures. Carbon rapidly diffuses into the skeletal structure to produce a carbon content in excess of the concentration necessary to form a martensite or pearlite microstructure in the cooled product. Also, during the early stages of sintering, the nickel boride produces a transient liquid phase that wets pore surfaces within the compact to provide intimate iron contact. Boron diffuses rapidly from the liquid phase into the iron. Nickel also diffuses from the liquid into the iron, but at a slower rate relative to the carbon and boron. Thus, the boride-derived liquid phase forms to promote nickel and boron diffusion, but dissipates after a short time to avoid skeletal distortion. The copper also forms a transient liquid phase coating pore surfaces and diffuses into the iron skeleton also at a rate slower than the boron or carbon diffusion. The slow diffusion of nickel and copper tend to concentrate these agents about the pores, whereas the boron and carbon tend to concentrate within interior regions of the iron skeleton. It is believed that the diffusion of carbon and boron into interior regions is encouraged by the concentration of nickel and copper about the pores. In any event, the carbon and boron accumulate at interior sites in the iron matrix and produce the desired hard borocementite particles.

Thus, in accordance with this invention, the iron powder compact contains carbon powder and a metal boride powder. Nickel boride is readily available and inexpensive and thus preferred. Cobalt boride and manganese boride are also suitable. The metal boride is selected to produce a transient liquid phase within the environment of the compact during sintering to promote diffusion of the constituents into the iron structure. Further, it is believed that diffusion of the nonferrous metal derived from the boride, being slower than carbon or boron, assists in driving the boron and carbon away from the pores. Copper, if added, also diffuses into the iron and similarly drives the boron and carbon to diffuse away from the pores. As a result, hard borocementite particles form within the matrix. Carbon dissolved in the iron matrix produces a martensite or pearlite matrix suitable for tightly holding the hard particles. The quantity and duration of the liquid phases during sintering is limited to avoid distortion of the iron skeleton. Thus, this invention produces a near net shape iron alloy product comprising large borocementite particles formed in-situ for improved wear resistance.

DESCRIPTION OF THE DRAWINGS

The present invention will be further illustrated with reference to the accompanying FIGURE which shows an optional photomicrograph of a microstructure produced in accordance with this invention, together with a scale indicating the extent of magnification.

DETAILED DESCRIPTION OF THE INVENTION

This invention is better understood by reference to the following examples.

EXAMPLE 1

An automotive distributor gear was manufactured by compacting and sintering a powder mixture comprising, by weight, about 94.1 parts plain iron powder, about 1.4 parts graphite powder, about 2.0 parts copper powder, about 0.8 parts nickel boride powder, about 1.7 parts iron boride powder and about 0.75 parts commercial die pressing lubricant. The iron powder was a low-carbon commercial grade material having a maximum carbon content of 0.01 weight percent and sized to −60 mesh. The graphite powder was a commercial synthetic powder available from Joseph Dixon Crucible Company, New Jersey, under the trade designation KS-2, and having particle sizes between about 2 and 5 microns. The metallic copper powder was composed of a commercial purity material sized to −325 mesh. Arc melted nickel boride powder composed substantially of intermetallic nickel boride compound NiB was added and contained about 14.8 percent boron, the balance nickel and impurities. The iron boride consisted substantially of intermetallic compound FeB and contained about 16 percent boron, the balance iron and impurities. To produce the powder, commercially available nickel boride and iron boride were fragmented and sized to −400 mesh. The die pressing lubricant was obtained from Glyco, Inc., Connecticut, under the trade designation Acrawax C Atomized.

The various powders were combined and blended into a uniform mixture. The mixture was placed into a die having substantially the desired size and shape of the gear. The powder mixture was compacted within the die to form a green compact having a density of about 6.7 grams per cubic centimeter.

The green compact was heated within a vacuum furnace in two steps. The furnace was evacuated to a pressure of about $8\times10_{-2}$ torr, whereafter the compact was heated to about 500° for a time, approximately one-half hour, sufficient to vaporize the lubricant. Thereafter, the furnace temperature was increased to 1120° C. and maintained for approximately 20 minutes for sintering. The sintered compact was removed from the furnace hot zone and cooled to room temperature while exposed to convective dry nitrogen gas.

The resulting microstructure is shown in the Figure. The Figure shows an iron matrix composed predominantly of martensite and fine pearlite and having pores B. The microstructure includes dispersed particles A, which were identified as borocementite by X-ray diffraction analysis and electron probe microanalysis. Hard particles A form approximately 17.5 volume percent of the microstructure, as indicated by quantitative metallography. In tests simulating gear use in an automotive engine, a gear formed of this structure exhibited scuffing wear resistance superior to that of a conventional chromium-alloyed cast iron distributor gear.

EXAMPLE 2

A second distributor gear was prepared by compacting and sintering, in a manner substantially similar to Example 1, a powder mixture comprising about 88.4 parts iron powder, 1.6 parts carbon graphite powder, 1.5 parts nickel boride powder, 5.5 parts iron boride powder, 3.0 parts copper powder and 0.75 parts fugitive die pressing lubricant. The resulting gear exhibited a microstructure similar in character to that of Example 1, but having about 28 volume percent hard particles and exhibited reduced wear in simulated automotive engine tests.

EXAMPLE 3

A powder metal gear was formed by compacting and sintering, in a manner substantially similar to Examples 1 and 2, a powder mixture composed of about 94.2 parts iron powder, 2.0 parts copper powder, 3.0 parts nickel boride powder, 1.4 parts carbon powder and 0.75 parts fugitive die pressing lubricant. The resulting microstructure exhibited approximately 22 percent by volume hard particles. The matrix was formed predominantly of martensite and fine pearlite, but also included approximately 10 volume percent austenite, located primarily about pores. This austenite is believed to be formed in accordance with the teachings of U.S. patent application Ser. No. 745,353, incorporated herein by reference. The product gear exhibited satisfactory wear resistance in simulated automotive engine tests.

EXAMPLE 4

A powder iron article was produced similar to Example 3, but substituting cobalt boride for the nickel boride. The cobalt boride contained 16.1 weight percent boron, the balance cobalt and impurities, and was ground to −400 mesh. A powder blend was prepared comprising about 3.0 parts cobalt boride powder, 2.0 parts copper powder, 1.4 parts carbon powder, 94.2 parts iron powder and about 0.55 parts fugitive die pressing lubricant. The blend was compacted to a density of about 6.7 grams per cubic centimeter and vacuum sintered at a pressure of about $10_{-2}$ torr. The sintering cycle included heating at about 500° C. for about 30 minutes to complete lubricant vaporization, thereafter heating to about 1120° C., holding the compact at about 1120° C. for about 20 minutes, and dry nitrogen gas quenching.

The resulting microstructure was about 74 volume percent fine pearlite and contained about 18 volume percent hard borocementite particles. The balance was mainly retained austenite regions about pores and martensite.

Thus, a product article in accordance with this invention comprises an iron alloy matrix having distributed therein a hard particulate phase composed of borocementite. Borocementite is an orthorhombic iron-boron-carbon intermetallic compound similar to cementite but containing a partial boron substitute for carbon. The boron substitution is not so great as to produce a tetragonal lattice characteristic of iron diboride $Fe_2B$. It is found that the borocementite particles produced by this invention are generally characterized by $Fe_3(C_xB_{1-x})$, wherein x is between 0.4 and 0.6. In addition to having a high hardness, the particles have adequate size to affect wear properties. Submicron particles are believed to be ineffective for this purpose. Also, the improvement in wear resistance is believed related to the hard particle volume fraction. It is found that less than about 4 volume percent hard particles does not significantly reduce wear. Greater than 30 percent hard particles may reduce wear, but is difficult to produce without localized skeletal distortion due to nonuniform distribution of the additives, particularly the carbon, which tends to segregate. A volume fraction between 10 and 30 percent is preferred.

The hard particles are distributed within a nonferrite matrix. A matrix formed of relatively hard martensite or pearlite is preferred. Optionally, the matrix may include a minor retained austenite fraction. The austenite may be stabilized about pores by the concentration of the boride-derived metal, particularly nickel or cobalt. This retained austenite may enhance toughness by inhibiting crack formation, as described in U.S. patent application Ser. No. 745,353. However, because austenite is relatively soft in comparison to martensite and pearlite, it is believed that austenite does not directly contribute to improved wear resistance. Also, soft austenite phase bordering the particles may not adequately bond the particles in the matrix, thus reducing the effectiveness of the particles. Therefore, it is desired to limit retained austenite in the microstructure to less than about 12 percent. An additional feature of the product microstructure is the location of hard particles at interior regions of the iron skeleton remote from pores. Thus, the particles are surrounded by and embedded in the hard matrix, as opposed to a location adjacent a pore whereat matrix contact with the particles is reduced and soft phases may be present.

In accordance with this invention, the iron alloy article is produced by sintering a mixture that is predominantly iron powder. The iron powder is suitably composed of iron or an iron alloy that does not contain significant carbon or boron. Carbon is added to the mixture in an amount sufficient to produce a hypereutectoid matrix concentration plus provide additional carbon for forming the desired hard particles. A small portion of the carbon, on the order of 0.03 weight percent, is lost during vacuum sintering. It is believed that a carbon addition less than 1.0 weight percent is insufficient to produce the desired 4 volume percent hard particles. Carbon additions greater than about 2 percent tend to result in segregation during processing that may form excessive liquid in localized regions during sintering that results in structural distortion. The carbon content is preferably between 1.2 and 1.8 weight percent.

Although not believed to be essential to the formation of hard borocementite particles, a copper addition is preferred. The copper alloying increases matrix hardness and swells the skeleton to compensate for iron shrinkage during sintering. Copper assists in driving carbon and boron from about pores to concentrate in interior regions that form the hard particles. This is attributed to a relatively low boron and carbon affinity for copper. For these reasons, it is desired to maximize the copper addition. However, greater than about 4 weight percent copper tends to produce excessive liquid formation during sintering and thus causes unwanted product distortion. In general, a copper addition between 2 and 3 weight percent is preferred.

A source for boron in the borocementite particles is provided by an addition of a suitable metal boride powder, optionally in combination with iron boride powder. It is desired to produce a liquid phase containing boron to promote diffusion into the iron matrix. In comparison to solid state diffusion, the liquid provides intimate contact with the iron and increases the activity of the constituent. However, it is desired to limit the volume and duration of the liquid to avoid erosion of the iron skeleton which results in structural distortion. In embodiments that also comprise a copper metal addition, it is further desired that the boron liquid dissipate before the copper melts at about 1083° C. to avoid formation of excessive liquid. Thus, a suitable boron source produces a transient liquid phase for a short time during the early stages of sintering, but rapidly dissipates upon diffusion of the constituents. A suitable boron source comprises a metal boride wherein the metal is selected from a group consisting of nickel, cobalt and manganese. Borides of these metals form liquid within the iron compact during sintering. For example, nickel boride forms a liquid as the iron compact is heated above about 1030° C. For comparison, iron boride does not form a liquid phase at preferred sintering temperatures, although iron boride may dissolve into a boride liquid phase after the phase has formed and is thus suitable for use in combination with nickel, cobalt or manganese boride. Furthermore, the relative affinity of boron is such that the boron rapidly diffuses into the iron from a liquid of the suitable metals. As the bulkier boride-derived metal diffuses into the iron, which diffusion is substantially slower than boron or carbon, it is believed that the metal drives boron and carbon toward interior regions of the structure, whereat the boron and carbon congregate in a concentration sufficient to produce the desired hard particles. In addition to powders formed of nickel boride, cobalt boride and manganese boride, it is believed that a boride additive containing more than one such metal, or such metal in combination with iron, is also suitable.

In general, the boron added is sufficient to produce a boron content in the product between about 0.15 and 1.2 weight percent. At least 0.15 weight percent boron is required to produce the desired 4 percent hard particles. However, excessive boride additions tend to produce excessive liquid phase and result in structural distortion. For nickel, it is desired to add at least about 0.8 weight percent nickel boride powder. However, a nickel boron addition greater than about 3.1 weight percent produces an excessive austenite phase that reduces wear resistance. Although additions of nickel boride NiB are preferred, other nickel boron powders may be substituted, such as $Ni_2B$ or alloys of NiB and Ni2B. A nickel concentration between about 0.7 and 2.7 percent is preferred. The balance of boron is added in the form of an iron boron alloy, preferably the iron boride FeB in the described examples. Because the atomic weights of cobalt and manganese are approximately equal to the nickel atomic weight, it is believed that comparable values apply for these metals.

In the described embodiment, the green compact is sintered within a vacuum furnace to minimize oxidation not only of the principle metals, but also of the boron. Sintering may be carried out by any suitable practice that minimizes contact with oxidizing species. For example, the compact may be suitably sintered while exposed to a reducing atmosphere, a cracked ammonia atmosphere, a hydrogen atmosphere or a dry inert gas atmosphere. In addition, a suitable sintering atmosphere may be derived from a hydrocarbon source such as methanol or propane. In embodiments comprising a preferred copper addition, sintering is suitably carried out at a temperature above 1083° C., the melting point of copper, so as to produce the desired copper liquid phase. Higher temperatures are desired to enhance iron diffusion bonding. However, practical problems are posed in handling the compacts at temperatures above 1150° C. A sintering temperature between 1110° C. and 1120° C. is preferred. It is desired that the time for sintering be sufficient for iron diffusion bonding and for diffusing the several alloys into the iron lattice. For sintering temperatures within the preferred range, sintering times between about 15 and 35 minutes produce satisfactory structures.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A powder metallurgical method for forming a wear resistant iron alloy article comprising compacting and sintering a powder mixture comprising, by weight of product metal, between about 1 and 2 percent carbon powder, optionally up to about 4 percent copper powder, a powdered boron source and the balance substantially low-carbon iron powder, said boron source comprising a metal boride containing a metal selected from the group consisting of nickel, cobalt and manganese and suitable for producing a transient liquid phase during sintering, said sintering being carried out at a temperature and for a time sufficient to bond said iron into an integral structure and to diffuse carbon and boron into said structure to produce a microstructure characterized by borocementite particles dispersed in an iron matrix formed predominantly of martensite or pearlite, said particles having a cross-sectional dimension greater than 1 micron and being present in an amount at least 4 volume percent to improve wear resistance.

2. A powder metallurgical method for forming a wear resistant iron alloy article comprising compacting and sintering a powder mixture comprising, by weight of product metal, between about 1 and 2 percent carbon powder, between about 2 and 3 percent copper powder, a powdered boron source in an amount effective to produce a boron concentration between about 0.15 and 1.2 percent, and the balance substantially low-carbon iron powder, said boron source comprising a metal boride containing a metal selected from the group consisting of nickel, cobalt and manganese and suitable for producing a transient liquid phase during sintering, said sintering being carried out at a temperature and for a time sufficient to bond said iron into an integral structure and to diffuse carbon, boron, copper and said metal into said structure to produce a predominantly martensite or pearlite microstructure, whereupon carbon and boron accumulate within regions of said structure to produce borocementite particles having a cross-sectional dimension greater than 1 micron and being present in an amount at least 4 volume percent to improve wear resistance.

3. A powder metallurgical method for forming a wear resistant article comprising compacting a powder mixture comprising, by weight of product metal, between about 1 and 2 percent carbon powder, between about 2 and 3 percent copper powder, a powdered boron source in an amount effective to produce a boron concentration between about 0.15 and 1.2 percent, and the balance substantially low-carbon iron powder, said boron source comprising nickel boride in an amount sufficient to produce a nickel concentration between about 0.7 and 2.7 weight percent, and sintering the mixture at a temperature and for a time sufficient to produce an integral structure having a microstructure characterized by borocementite particles dispersed in predominantly martensite or pearlite matrix, said particles having a cross-sectional dimension greater than 1 micron and being present in an amount at least 4 volume percent to improve wear resistance.

4. A powder metallurgical method for forming a wear resistant article comprising compacting a powder mixture comprising, by weight of product metal, between about 1 and 2 percent carbon powder, between about 2 and 3 percent copper powder, a powdered boron source in an amount effective to produce a boron concentration between about 0.15 and 1.2 percent, and the balance substantially low-carbon iron powder, said boron source comprising 0.8 to 3.1 percent powder composed of nickel boride compound, and optionally a powder composed of iron boride compound, and sintering the mixture at a temperature between 1100° C. and 1150° C. and for a time sufficient to produce an integral structure having a microstructure comprising between about 10 and 30 volume percent borocementite particles dispersed in an iron matrix formed predominantly of martensite or pearlite, said particles having a cross-sectional dimension greater than 1 micron and being effective to improve wear resistance.

5. A powder metallurgical method for forming a wear resistant article comprising compacting a powder mixture comprising, by weight of product metal, between 1.2 and 1.8 percent carbon powder, between 2 and 3 percent copper powder, a powdered boron source in an amount effective to produce a boron concentration between about 0.15 and 1.2 percent, and the balance substantially low-carbon iron powder, said boron source comprising 0.8 to 3.1 percent powder composed of nickel boride compound, and the balance a powder composed of iron boride compound, and sintering the mixture at a temperature and for a time sufficient to diffusion bond the iron powder into an integral structure and to diffuse carbon, boron, copper and nickel into the structure to produce a microstructure comprising dispersed borocementite particles having a cross-sectional dimension greater than 1 micron and present in an amount between 10 and 30 volume percent to substantially improve wear resistance.

6. A wear resistant powder iron alloy article comprising, by weight, between about 1 and 2 percent carbon, up to about 4 percent copper, between about 0.15 and 1.2 percent boron, between 0.7 and 2.7 percent of a metal selected from the group consisting of nickel, cobalt and manganese and the balance substantially iron, said article comprising an iron alloy matrix and borocementite particles dispersed within the matrix, said matrix being formed predominantly of an iron phase selected from the group consisting of martensite and pearlite, said borocementite particles having a cross-sectional dimension greater than .1 micron and being present in an amount at least 4 volume percent to substantially improve wear resistance of the article.

7. A wear resistant powder iron alloy article comprising, by weight, between about 1.2 and 1.8 percent carbon, between 2 and 3 percent copper, between 0.15 and 1.2 percent boron, between 0.7 and 2.7 percent nickel and the balance substantially iron, said article comprising an iron alloy matrix and borocementite particles dispersed within the matrix, said matrix being formed predominantly of an iron phase selected from the group consisting of martensite and pearlite, said borocementite particles having a cross-sectional dimension greater than 1 micron and being present in an amount between 10 and 30 volume percent and effective to substantially improve wear resistance of the article.

* * * * *